US012600535B2

(12) United States Patent
Hall et al.

(10) Patent No.: US 12,600,535 B2
(45) Date of Patent: Apr. 14, 2026

(54) DUAL LID CANISTER ASSEMBLY WITH A POUR SPOUT

(71) Applicant: Buddeez, Inc., Wentzville, MO (US)

(72) Inventors: Charles E. Hall, Wentzville, MO (US); William A. Hall, Wentzville, MO (US)

(73) Assignee: Buddeez, Inc., Wentzville, MO (US)

( * ) Notice: Subject to any disclaimer, the term of this patent is extended or adjusted under 35 U.S.C. 154(b) by 188 days.

(21) Appl. No.: 18/437,553

(22) Filed: Feb. 9, 2024

(65) Prior Publication Data

US 2025/0256893 A1 Aug. 14, 2025

(51) Int. Cl.
*B65D 47/06* (2006.01)
*B65D 47/12* (2006.01)

(52) U.S. Cl.
CPC ..... *B65D 47/065* (2013.01); *B65D 47/122* (2013.01); *B65D 2547/066* (2013.01)

(58) Field of Classification Search
CPC ..... B65D 47/065; B65D 47/122; B65D 2547/066
See application file for complete search history.

(56) References Cited

U.S. PATENT DOCUMENTS 3,154,226 A * 10/1964 Petitto ..... B65D 47/046 222/530
4,732,303 A * 3/1988 Wang ..... B65D 47/305 222/536
5,484,089 A * 1/1996 Picerno ..... B65D 83/04 222/536
5,961,010 A * 10/1999 Smith ..... B65D 47/305 222/533
2004/0011827 A1* 1/2004 Lee ..... B65D 47/261 222/522
2025/0256893 A1* 8/2025 Hall ..... B65D 47/065

FOREIGN PATENT DOCUMENTS

CN 204822508 U * 12/2015 ..... B65D 47/065
JP 2000335616 A * 12/2000 ..... A47G 19/2266

* cited by examiner

*Primary Examiner* — Bob Zadeh
(74) *Attorney, Agent, or Firm* — Sandberg Phoenix & von Gontard, P.C.

(57) ABSTRACT

A canister assembly includes a canister having a top opening into an interior of the canister, a first lid removably attached on the canister over the top opening with the first lid having a lid opening through the first lid, a spout on the first lid at the lid opening with the spout being movable between a closed position where the spout extends over and closes the lid opening and an opened position where the spout extends from and opens the lid opening, and a second lid that is removably attached to the first lid with the second lid extending over the spout when the spout is in the closed position with the second lid holding the spout in the closed position.

17 Claims, 7 Drawing Sheets

DUAL LID CANISTER ASSEMBLY WITH A POUR SPOUT

BACKGROUND OF THE INVENTION

This disclosure pertains to a canister assembly comprising a canister, a first lid with a pour spout, and a second lid. More specifically, this disclosure pertains to a canister for storing and dispensing a product, a first lid with a pour spout that is removably attachable to the canister with the spout being movable between an opened position where the spout is usable to dispense the product from the canister and a closed position where the spout seals the product in the canister, and a second lid that is removably attachable on the first lid and provides a seal over the spout on the first lid.

SUMMARY OF THE INVENTION

A canister assembly includes a canister having an opening in a top wall of the canister into an interior of the canister. The canister has a first indentation and a second indentation in opposite side walls of the canister that form a manual handle on the canister.

The canister assembly also includes a first lid removably attached on the top wall of the canister over the opening into the canister. The first lid has a lid opening through the first lid.

A spout is provided on the first lid at the lid opening. The spout has the configuration of a chute or trough with a bottom pour panel and first and second guide panels on opposite sides of the pour panel. The panels are interconnected with a U-shaped cross section configuration. The spout is movable on the first lid between a closed position where the spout extends over and closes the lid opening and an opened position where the spout extends from the lid opening and opens the lid opening.

A second lid is removably attached to the first lid. The second lid extends over the spout when the spout is in the closed position on the first lid. With the second lid removably attached to the first lid, the second lid extends over the spout in the closed position and prevents the spout from being moved from the closed position to the opened position.

The first lid has a flat top surface with the lid opening extending through the flat top surface.

The second lid has a flat bottom surface. The flat bottom surface of the second lid is positioned adjacent and covering over the flat top surface of the first lid and the opening through the first lid when the second lid is removably attached on the first lid.

The features, functions and advantages that have been discussed can be achieved independently in various embodiments or may be combined in yet other embodiments, further details of which can be seen with reference to the following drawings and description.

BRIEF DESCRIPTION OF DRAWINGS

Further objects and features of the canister assembly are set forth in the following detailed description of the assembly and in the drawing figures.

DETAILED DESCRIPTION OF THE INVENTION

Figure 1:
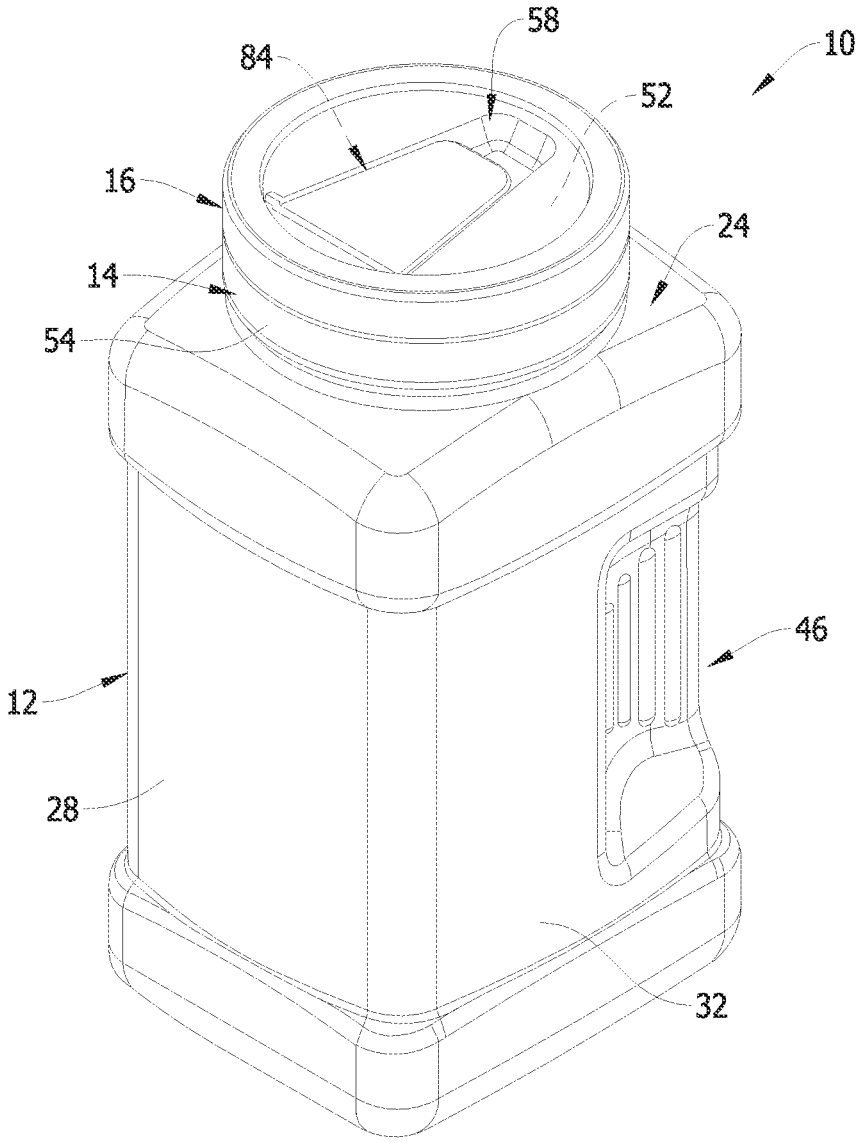
FIG. 1 is a representation of a top perspective view of the canister assembly.
Figure 2:
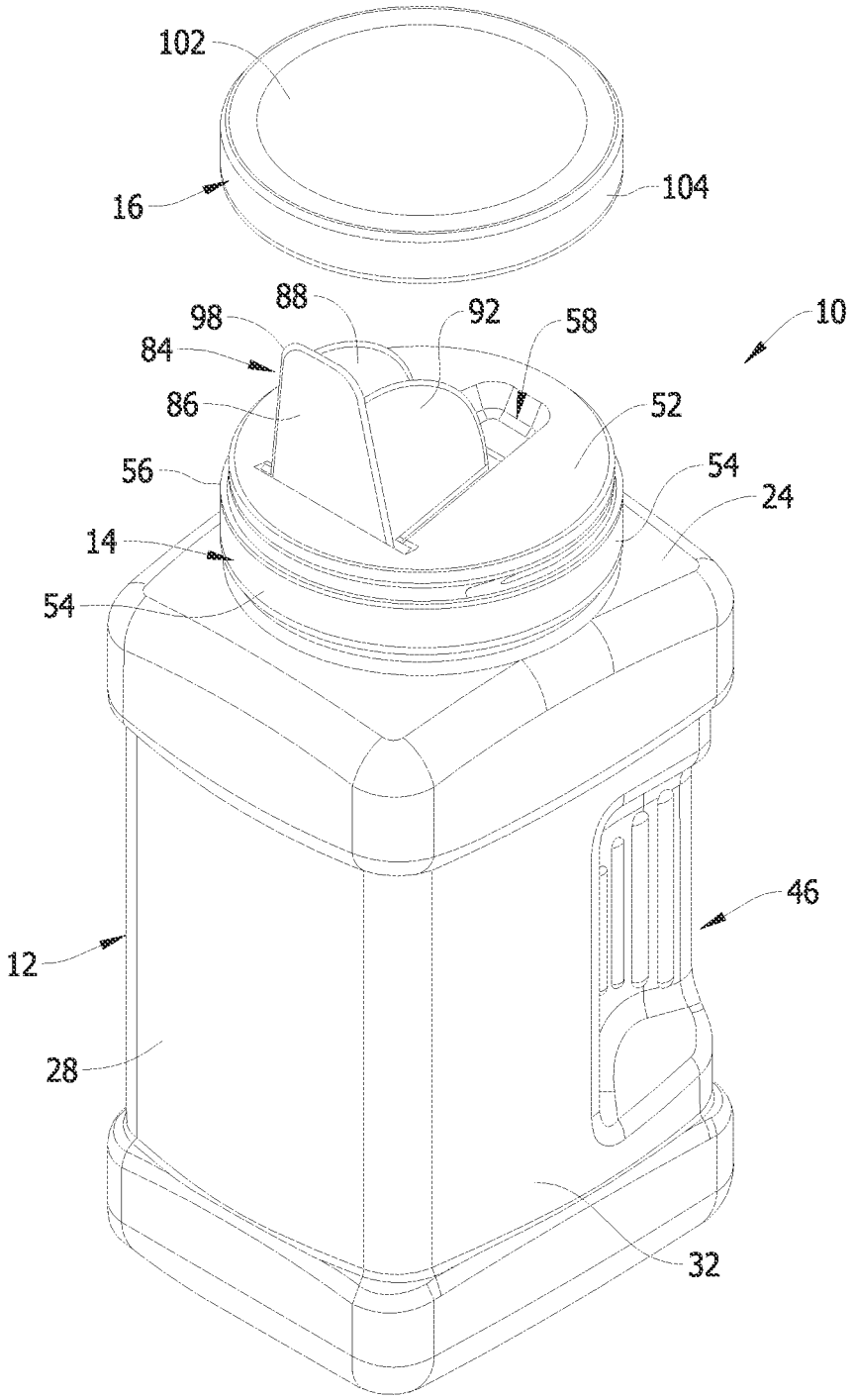
FIG. 2 is a representation of the canister assembly similar to that of FIG. 1, with the second lid removed.

As represented in the drawing figures, the canister assembly 10 of this disclosure is basically comprised of a canister 12, a first lid 14 that is removably attachable to the canister 12, and a second lid 16 that is removably attachable to the first lid 14. Each of these component parts is constructed of a material that provides the parts with sufficient structural strength for the intended functioning of the canister assembly 10. For example, the material could be a plastic material or any other equivalent type of material. Additionally, certain component parts of the canister assembly can be transparent, for example the canister 12 and also the second lid 16 if desired. The second lid 16 is represented as being transparent in FIGS. 1, 3, 7 and 8.

The canister 12 has a general configuration of a rectangular block defined by a bottom wall 22 and an opposite top wall 24, a first side wall 26 and an opposite second side wall 28, a third side wall 32 and an opposite fourth side wall 34. The canister can have other equivalent configurations. The bottom wall 22, top wall 24, first side wall 26, second side wall 28, third side wall 32 and fourth side wall 34 are all interconnected as a single unit. As stated earlier, the canister 12 could be constructed of a transparent plastic material to enable an observer to determine an amount of product in the interior 36 of the canister 12.

The canister 12 includes a cylindrical neck 38 that extends upwardly from the top wall 24 of the canister. The neck 38 has a cylindrical exterior surface with screw threading 42 formed on the exterior surface. The neck 38 as a cylindrical interior surface that surrounds a top opening 44 of the canister 12 that provides access to the interior 36 of the canister. The cylindrical configuration of the neck 38 is centered on the top wall 24 of the canister 12 and the interior 36 of the canister 12.

There is a first indentation 46 formed in the first side wall 26 and the third side wall 32 where the first side wall and third side wall merge. There is a second indentation 48 formed in the first side wall 26 and the fourth side wall 34 where the first side wall and the fourth side wall merge. The first indentation 46 and second indentation 48 form a hand grip or manual handle on the first side wall 26 that facilitates manually gripping the canister 12 when transporting the canister or when inverting the canister to dispense product from the canister. Alternatively, the hand grip could be formed by just the third side wall 32 and the fourth side wall 34 being spaced apart by the first side wall 26 a distance that enables gripping the canister 12 by the thumb and fingers of a single hand engaging the third side wall 32 and the fourth side wall 34.

The first lid 14 has a circular top surface 52 that is substantially flat. A cylindrical rim 54 depends downward from the periphery or peripheral edge of the top surface 52. The rim 54 has internal screw threading that is complementary to the external screw threading 42 on the neck 38 of the canister 12. The rim 54 also has external screw threading 56 that extends around the top of the rim 54 where the rim merges into the top surface 52 of the first lid 14. The rim 54 has a gripping surface below the external screw threading 56 that also extends around the rim. There is a recess 58 formed into the first lid top surface 52 adjacent the rim 54. As represented in FIGS. 1-3, 8 and 9, when the first lid 14 is attached to the canister neck 38 the mating internal threaded surface of the first lid rim 54 and the external threaded surface of the neck 38 position the recess 58 between the first indentation 46 and the second indentation 48 on the canister 12.

There is an opening 62 through the top surface 52 of the first lid 14. The opening 62 has a general trapezoidal configuration that is defined by a first edge 64 and an opposite second edge 66, a third edge 68 and an opposite fourth edge 72. There is a first slot 74 formed through the top surface 52 of the first lid 14 at the intersection of the first edge 64 and the third edge 68. There is a second slot 76 formed through the top surface 52 of the first lid 14 at the intersection of the second edge 66 and the third edge 68. There is a first pivot indentation 78 formed in the top surface 52 of the first lid 14 at the intersection of the first edge 64 and the fourth edge 72. There is a second pivot indentation 82 formed in the top surface 52 of the first slit 14 at the intersection of the second edge 66 and the fourth edge 72.

There is a pour spout 84 mounted on the top surface 52 of the first lid 14 for movement through the opening 62 in the top surface. The spout 84 has a configuration of a chute or trough with an open top. The spout configuration includes a poor panel 86 at the bottom of the spout that supports and guides product dispensed from the canister assembly 10. The spout 84 also includes a first guide panel 88 and a second guide panel 92 at opposite sides of the pour panel 86. The pour panel 86, first guide panel 88 and second guide panel 92 are connected together with a general U-shaped cross section configuration that is open at the top. The open top enables viewing product at it is dispensed across the pour spout trough. Together the pour panel 86, the first guide panel 88 and the second guide panel 92 function as a chute or trough that guides product dispensed from the canister 12 through the lid opening 62 and across the pour panel 86 when dispensing product from the canister assembly 10.

Figure 3:
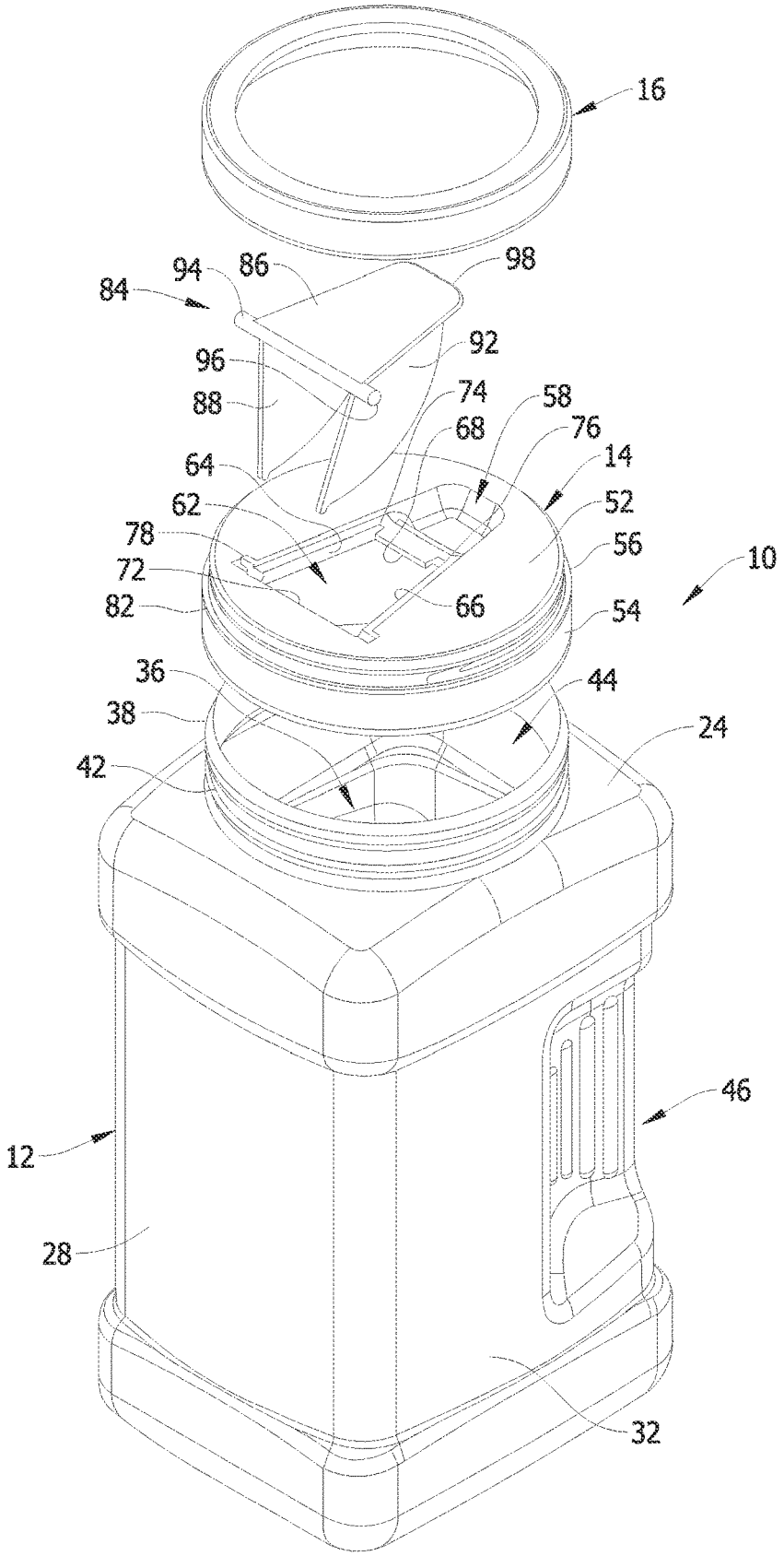
FIG. 3 is a representation of a top perspective, exploded view of the component parts of the canister assembly.
Figure 4:
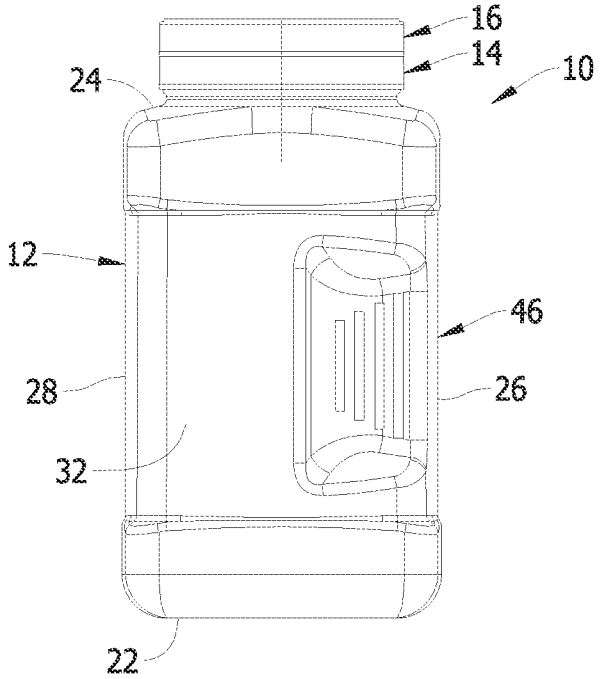
FIG. 4 is a representation of a side elevation view of the canister assembly, with the opposite side of the canister assembly being a mirror image thereof.
Figure 5:
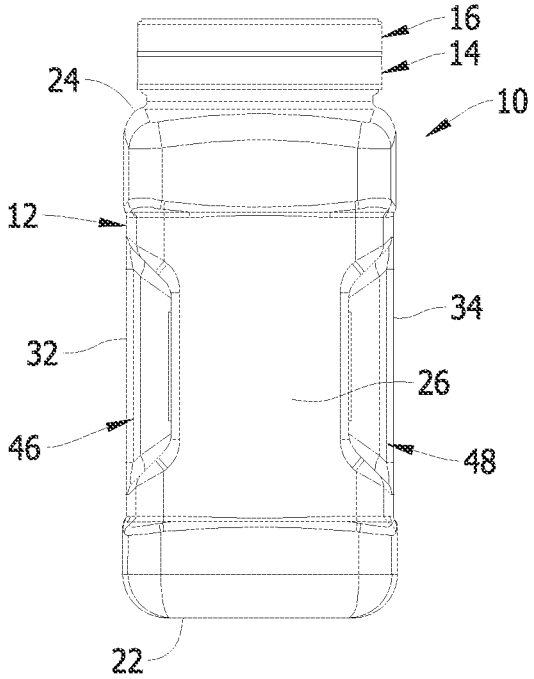
FIG. 5 is a representation of a front elevation view of the canister assembly.
Figure 6:
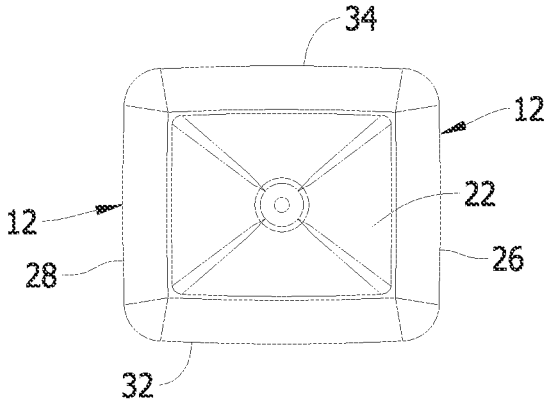
FIG. 6 is a representation of a bottom plan view of the canister assembly.
Figure 7:
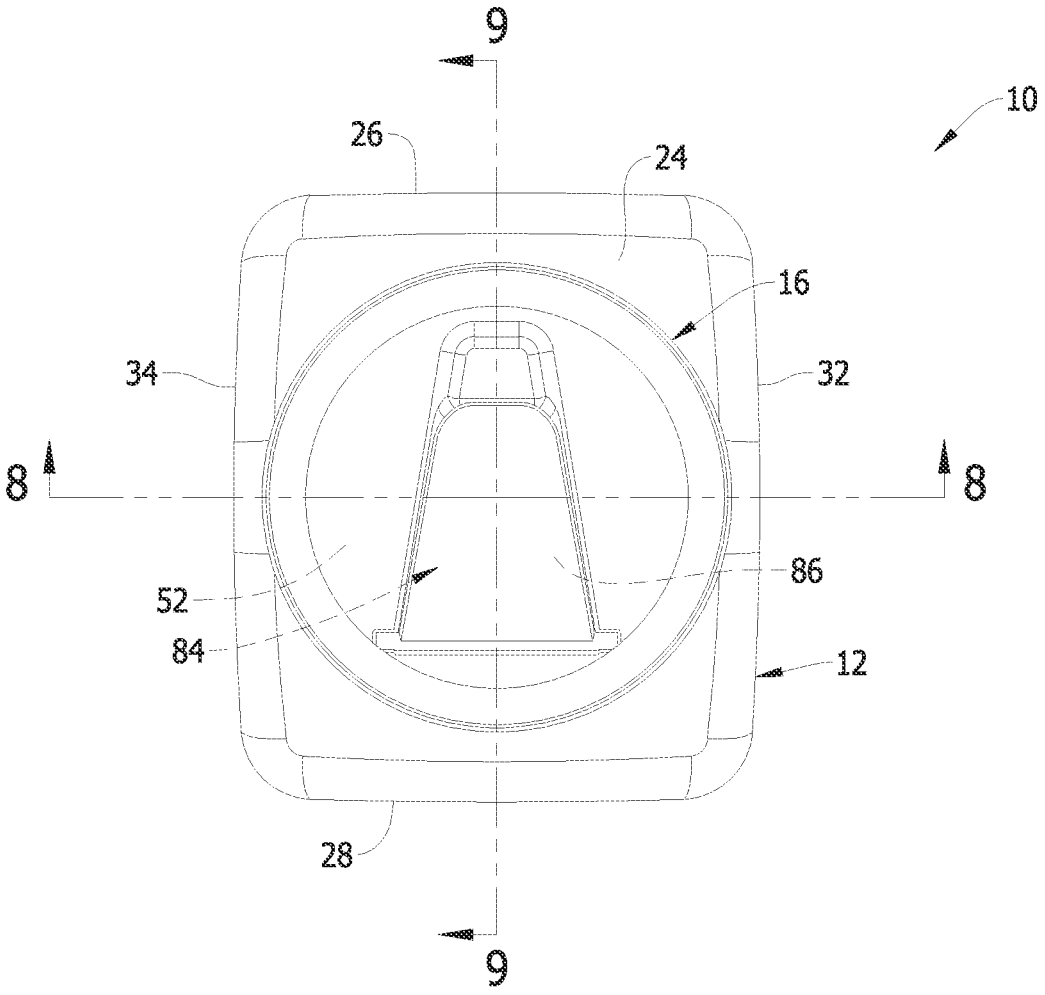
FIG. 7 is a representation of a top plan view of a canister assembly.

As represented in FIG. 3, the spout 84 also includes a first pivot pin 94 and a second pivot pin 96 that engage in the respective first pivot indentation 78 and second period indentation 82 in the top surface 52 of the first lid 14. The engagement of the pivot pins in the pivot indentations create a pivot connection between the pour spout 84 and the first lid 14. Other equivalent pivot connections between the spout 84 and the first lid 14. The pivot connection enables the spout 84 to be moved between an opened position represented in FIG. 2 and a closed position represented in FIG. 1. The first guide panel 88 and the second guide panel 92 have free edges that extend into the respective first slot 74 and second slot 76. The engagement of the first guide panel 88 in the first slot 74 and the engagement of the second guide panel 92 in the second slot 76 guide the movement of the first guide panel 88 and second guide panel 92 through the opening 62 in the lid top surface 52 as the spout is moved between the opened and closed positions.

Figure 9:
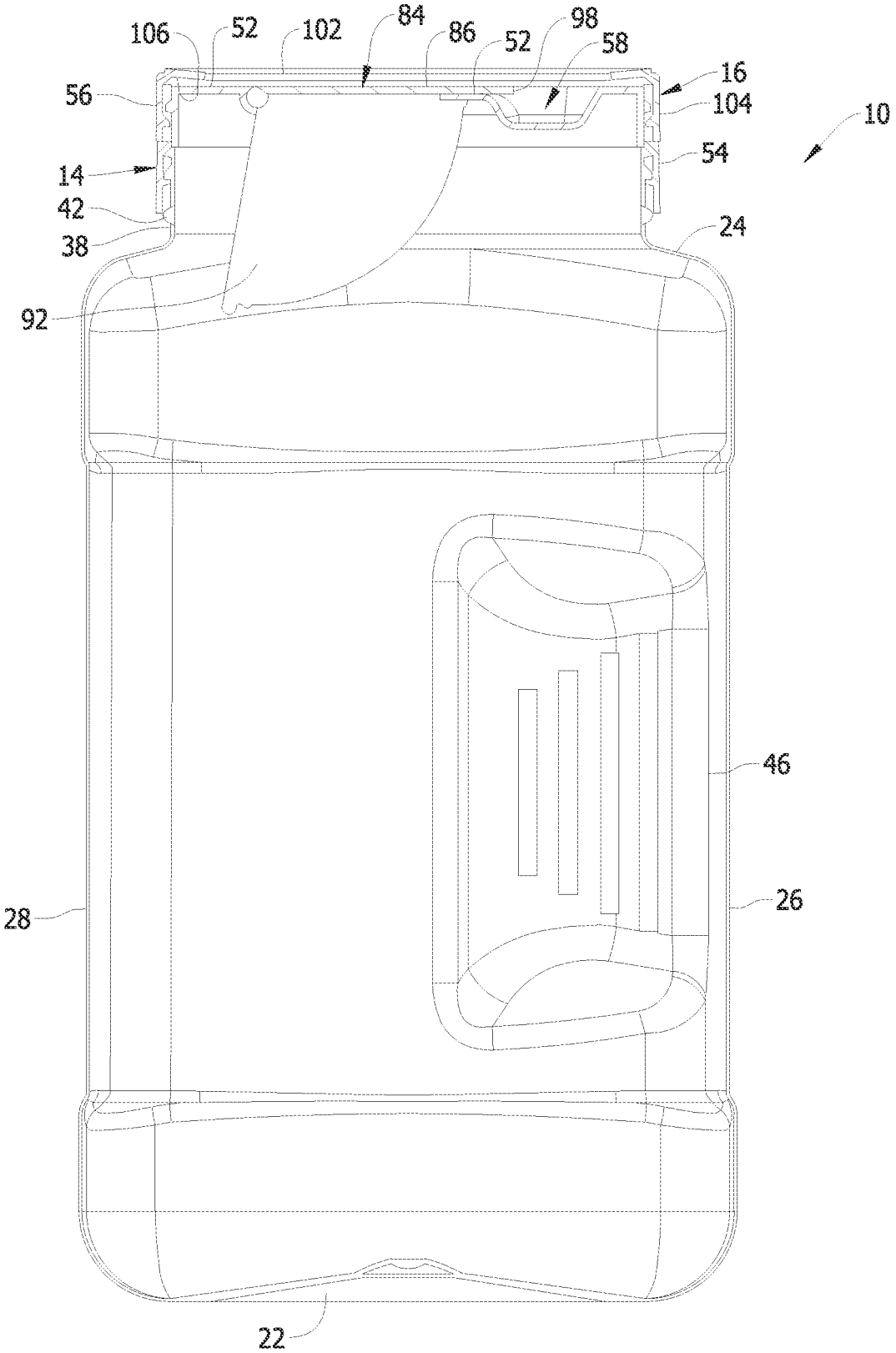
FIG. 9 is a representation of a cross section view of the canister assembly in the plane of line 9-9 of FIG. 7.

There is a general U-shaped spout flange 98 that extends outwardly from and around the pour panel 86 where the pour panel merges with the first guide panel 88 and the second guide panel 92. The flange 98 engages against the top surface 52 of the first lid 14 when the spout 84 is moved to the closed position over the opening 62 in the top surface 52. The flange 98 forms a seal around the opening 62 when the spout 84 is moved to the closed position on the top surface 52 of the first lid 14. As represented in FIG. 9, a portion of the flange 98 extends over the recess 56 formed in the lid top surface 52. This enables a user to insert a finger into the recess 58 and beneath the flange 98 to easily engage the flange 98 and move the flange and the spout 84 from the closed position of the spout to the opened position of the spout.

Figure 8:
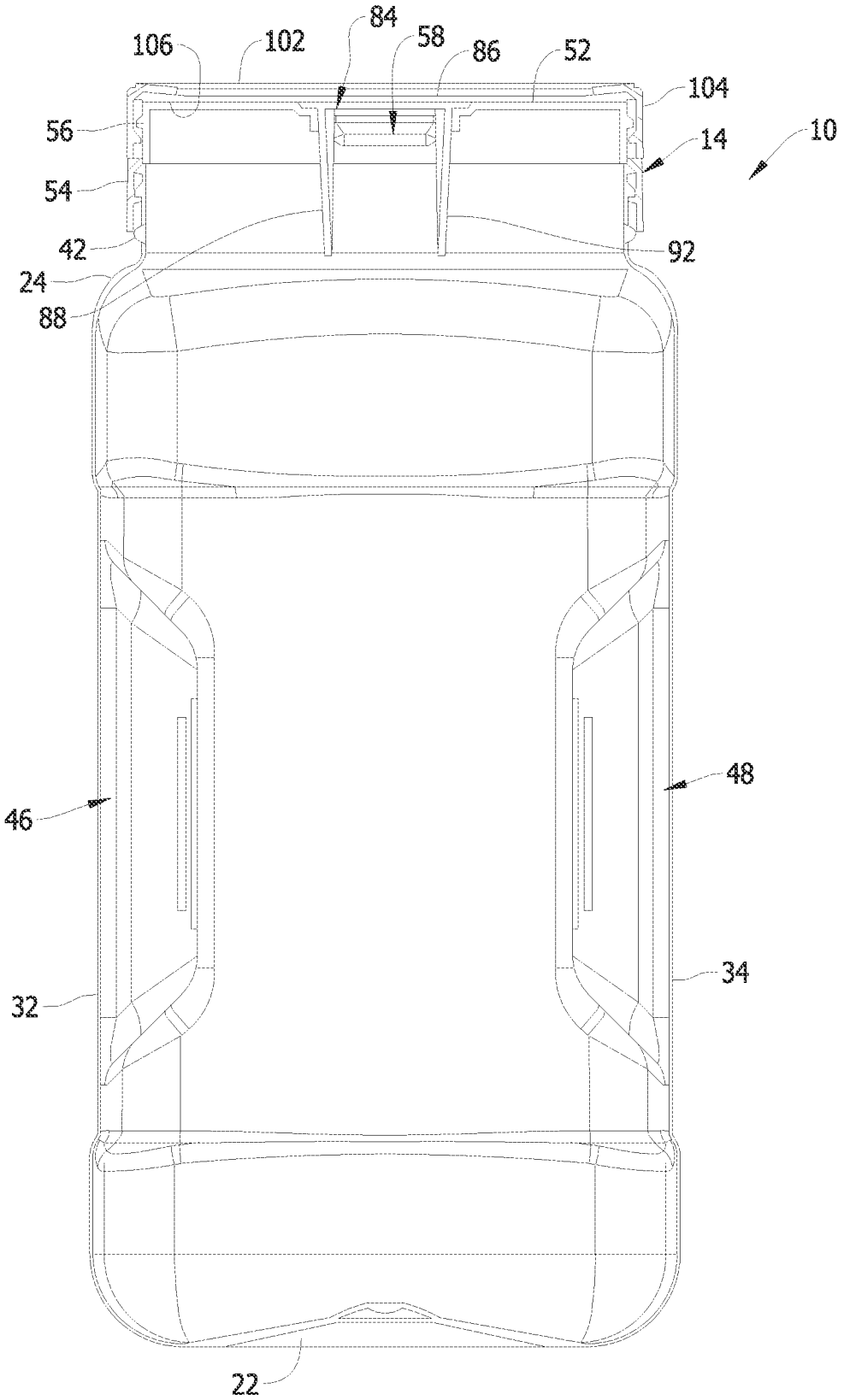
FIG. 8 is a representation of a cross section view of the canister assembly in the plane of line 8-8 of FIG. 7.

As represented in FIGS. 8 and 9, the second lid 16 has a circular top surface 102 that is substantially flat. A cylindrical rim 104 extends downwardly from the periphery or peripheral edge of the top surface 102 of the second lid 16. The rim 104 has internal screw threading that is complementary to the external screw threading 56 of the first lid 14. The rim 104 surrounds a bottom surface 106 of the second lid 16 that is also substantially flat. With the second lid 16 removable attached to the first lid 14 the bottom surface 106 of the second lid extends over and covers over the first lid top surface 52, over the opening 62 through the first lid top surface 52 and over the spout 84 in the closed position of the spout on the first lid 14 and prevents the spout 84 from being moved from the closed position to the opened position.

As various modifications could be made in the construction of the dual lid canister assembly with a poor spout and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

The invention claimed is:

1. A canister assembly comprising:

a canister, the canister having a canister opening;

a first lid, the first lid having a lid opening through the first lid, the first lid being removably attached to the canister with the first lid extending over the canister opening, the first lid having a flat top surface and a cylindrical rim extending around a periphery of the flat top surface;

a spout on the first lid at the lid opening, the spout being movable on the first lid between a closed position where the spout extends over and closes the lid opening and an opened position where the spot extends from and opens the lid opening; and a second lid, the second lid being removably attached to the first lid with the second lid extending over the spout with the spout in the closed position on the first lid, the second lid having a flat top surface and a cylindrical rim extending around a periphery of the flat top surface of the second lid;

the rim of the second lid is removably attached to the rim of the first lid to removably attach the second lid to the first lid;

the rim of the first lid having external screw threading on the rim; and the rim of the second lid having internal screw threading that mates with the external screw threading on the rim of the first lid and removably attaches the second lid to the first lid.

2. The canister assembly of claim 1, further comprising:
the second lid removably attached to the first lid extends over the spout in the closed position of the spout on the first lid and prevents the spout from being moved from the closed position to the opened position.

3. The canister assembly of claim 1, further comprising:
a flange on the spout, the flange projecting from the spout and extending around the spout, the flange engages with the first lid and closes the lid opening when the spout is in the closed position on the first lid.

4. The canister assembly of claim 3, further comprising:
a recess in a top surface of the first lid; and
the flange extends over the recess when the spout is in the closed position of the spout on the first lid.

5. The canister assembly of claim 4, further comprising:
a first indentation in the canister;
a second indentation in the canister, the first indentation and the second indentation forming a manual handle on the canister; and
the flange on the spout and the recess in the top surface of the first lid being positioned between the first indentation and the second indentation.

6. The canister assembly of claim 1, further comprising:
the spout having a configuration of a trough with a bottom panel and first and second guide panels on opposite sides of the bottom panel, the bottom panel and first and second guide panels having a U-shaped cross section configuration.

7. A canister assembly comprising:
a canister, the canister having a canister opening;
a first lid, the first lid having a lid opening through the first lid, the first lid being removably attached to the canister with the first lid extending over the canister opening;
a spout on the first lid at the lid opening, the spout having a configuration of a trough with a bottom panel and first and second guide panels on opposite sides of the bottom panel, the bottom panel and first and second guide panels having a U-shaped cross section configuration, the spout being movable on the first lid between a closed position where the spout extends over and closes the lid opening and an opened position where the spot extends from and opens the lid opening, the spout having a pivot connection between the spout and the first lid that is configured to guide movement of the first guide panel of the spout and the second guide panel of the spout through the opening in the first lid as the spout is moved between the opened position and the closed position; and
a second lid, the second lid being removably attached to the first lid with the second lid extending over the spout with the spout in the closed position on the first lid.

8. The canister assembly of claim 7, further comprising:
the second lid removably attached to the first lid extends over the spout in the closed position of the spout on the first lid and prevents the spout from being moved from the closed position to the opened position.

9. The canister assembly of claim 7, further comprising:
the first lid has a flat top surface and a cylindrical rim extending around a periphery of the flat top surface;
the second lid has a flat top surface and a cylindrical rim extending around a periphery of the flat top surface of the second lid; and
the rim of the second lid is removably attached to the rim of the first lid to removably attach the second lid to the first lid.

10. The canister assembly of claim 9, further comprising:
the rim of the first lid has external screw threading on the rim; and
the rim of the second lid has internal screw threading that mates with the external screw threading on the rim of the first lid and removably attaches the second lid to the first lid.

11. The canister assembly of claim 7, further comprising:
a flange on the spout, the flange projecting from the spout and extending around the spout, the flange engages with the first lid and closes the lid opening when the spout is in the closed position on the first lid.

12. The canister assembly of claim 11, further comprising:
a recess in a top surface of the first lid; and
the flange extends over the recess when the spout is in the closed position of the spout on the first lid.

13. The canister assembly of claim 12, further comprising:
a first indentation in the canister;
a second indentation in the canister, the first indentation and the second indentation forming a manual handle on the canister; and
the flange on the spout and the recess in the top surface of the first lid being positioned between the first indentation and the second indentation.

14. A canister assembly comprising:
a canister, the canister having a canister opening;
a first lid, the first lid having a flat top surface with a lid opening through the flat top surface of the first lid, the first lid being removably attached to the canister with the first lid extending over the canister opening;
a spout on the first lid at the lid opening, the spout being movable on the first lid between a closed position where the spout extends over and closes the lid opening and an opened position where the spot extends from and opens the lid opening;
a flange on the spout, the flange projecting from the spout and extending around the spout, the flange engages with the flat top surface of the first lid and closes the lid opening when the spout is in the closed position on the first lid; and
a second lid, the second lid having a flat bottom surface, the second lid being removably attached to the first lid with the flat bottom surface of the second lid positioned adjacent and covering over the flat top surface of the first lid and the spout with the spout in the closed position on the first lid.

15. The canister assembly of claim 14, further comprising:
the second lid removably attached to the first lid extends over the spout in the closed position of the spout on the first lid and prevents the spout from being moved from the closed position to the opened position.

16. The canister assembly of claim 14, further comprising:
a recess in the flat top surface of the first lid; and
the flange extends over the recess when the spout is in the closed position of the spout on the first lid.

17. The canister assembly of claim 14, further comprising:
the spout having a configuration of a trough with a bottom panel and first and second guide panels on opposite sides of the bottom panel, the bottom panel and first and second guide panels having a U-shaped cross section configuration.

* * * * *